US006817882B1

(12) United States Patent
Bauer et al.

(10) Patent No.: US 6,817,882 B1
(45) Date of Patent: Nov. 16, 2004

(54) DEVICE FOR LOCKING A PLUG IN THE PLUG-IN POSITION THEREOF IN A VIBRATION RESISTANT MANNER

(75) Inventors: Peter-Josef Bauer, Tienen (BE); Thomas Lott, Buehl (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/221,299

(22) PCT Filed: Nov. 11, 2000

(86) PCT No.: PCT/DE00/04255

§ 371 (c)(1),
(2), (4) Date: Apr. 21, 2003

(87) PCT Pub. No.: WO01/69727

PCT Pub. Date: Sep. 20, 2001

(30) Foreign Application Priority Data

Mar. 11, 2000 (DE) ..... 100 11 925

(51) Int. Cl.[7] ..... H01R 13/625
(52) U.S. Cl. ..... 439/347; 439/911
(58) Field of Search ..... 439/347, 911

(56) References Cited

U.S. PATENT DOCUMENTS 3,683,314 A 8/1972 Elkins
4,034,172 A * 7/1977 Glover et al. ..... 200/51.1
4,146,682 A * 3/1979 Nakao ..... 429/97
4,740,168 A * 4/1988 Carney et al. ..... 439/133
4,941,839 A * 7/1990 Nagasaka et al. ..... 439/352
5,464,351 A 11/1995 Oka
5,871,364 A 2/1999 Shinchi
6,336,819 B1 * 1/2002 Ishii et al. ..... 439/147

FOREIGN PATENT DOCUMENTS

DE 21 19 915 A 11/1972
DE 197 01 739 A1 7/1998
DE 198 18 677 A 11/1999

* cited by examiner

*Primary Examiner*—Neil Abrams
(74) *Attorney, Agent, or Firm*—Michael J. Striker

(57) ABSTRACT

The apparatus (2) for vibrationproof locking of a plug (3) in its plugged-in position inside a unit, in particular inside a clutch actuator (1), encompasses a housing (4) that has a housing top shell (16) and a housing bottom shell (6), by means of at least one locking element (30) that engages the plug (3). The locking element (30) has a blocking section (52), which is kept in a blocking position by the plug (3) when this plug is not completely plugged in—thus preventing the housing shells (6) from being joined—and which can be brought into a position that permits the housing shells (6) to be joined only when the plug (3) is completely plugged in.

10 Claims, 2 Drawing Sheets

DEVICE FOR LOCKING A PLUG IN THE PLUG-IN POSITION THEREOF IN A VIBRATION RESISTANT MANNER

BACKGROUND OF THE INVENTION

The invention is based on an apparatus for vibrationproof locking of a plug in its plugged-in position inside a unit, in particular inside a clutch actuator, with a housing that has at least two housing shells.

A known clutch actuator for engaging and disengaging a vehicle clutch according to DE 197 01 739 A1 is integrated into a dual-shelled housing, which is comprised of a housing bottom shell and a housing top shell, which can be pivoted in relation to each other around a pivot axis so that two flanges formed onto each housing shell rest against each other with a seal between them. The housing bottom shell contains an electric motor for driving a tappet that is connected to a piston of a hydraulic master cylinder. In order to supply power to the electric motor, electrical plug connections are required, that are produced, for example, by plug connectors that are disposed at the end of power cables and are plugged into associated sockets or plugging locations on the electric motor.

Clutch actuators of this kind are subjected to vehicular vibrations, which leads to the problem of the plugs coming loose over time due to the vibration. As a result, plugs that are subjected to vibrations are often secured with additional locking elements such as screw connections, pin connections, clips, or the like, which are intended to secure the plug in the plugged-in position. Locking elements of this kind, however, usually do not prevent the plug from being plugged in incompletely or in a tilted fashion, which brings the danger of an electrical contact not being produced or only being produced to an insufficient degree.

SUMMARY OF THE INVENTION

The apparatus according to the invention for vibrationproof locking of a plus in its plugged-in position, has the advantage that a further assembly of the unit is prevented if the plug is not in its final plugged-in position so that a correction installation of the plug is assured every time. In addition, no additional parts are required since the blocking section of the locking element that is already provide performs the blocking function.

A particularly preferable modification of the invention provides that only after the plug is completely plugged in is a section of the plug flush with an associated section of the locking element and only then can the locking element be moved in relation to the housing into a locking position in which the section of the plug is overlapped by the associated section of the locking element in order to secure the plug in the plugged-in position. Since a locking is only possible in a correct plugged position, incorrect plugged positions of the plug become immediately apparent.

Another preferable measure provides that the locking element is held in the locking position by the housing top shell that is placed onto the housing bottom shell. Since the mounted housing top shell prevents an unlocking, the locking of the plug is self-securing and cannot unintentionally come loose, which is particularly advantageous in plug connections that are subjected to vibration.

According to one modification, the blocking section simultaneously serves as a grasping section for actuating the locking element and is flat in design. This achieves an advantageous functional combination because it saves space.

BRIEF DESCRIPTION OF THE DRAWINGS

Exemplary embodiments of the invention are shown in the drawings and will be explained in detail in the subsequent description.

DESCRIPTION OF THE PREFERRED EMBODIMENT

Figure 1:
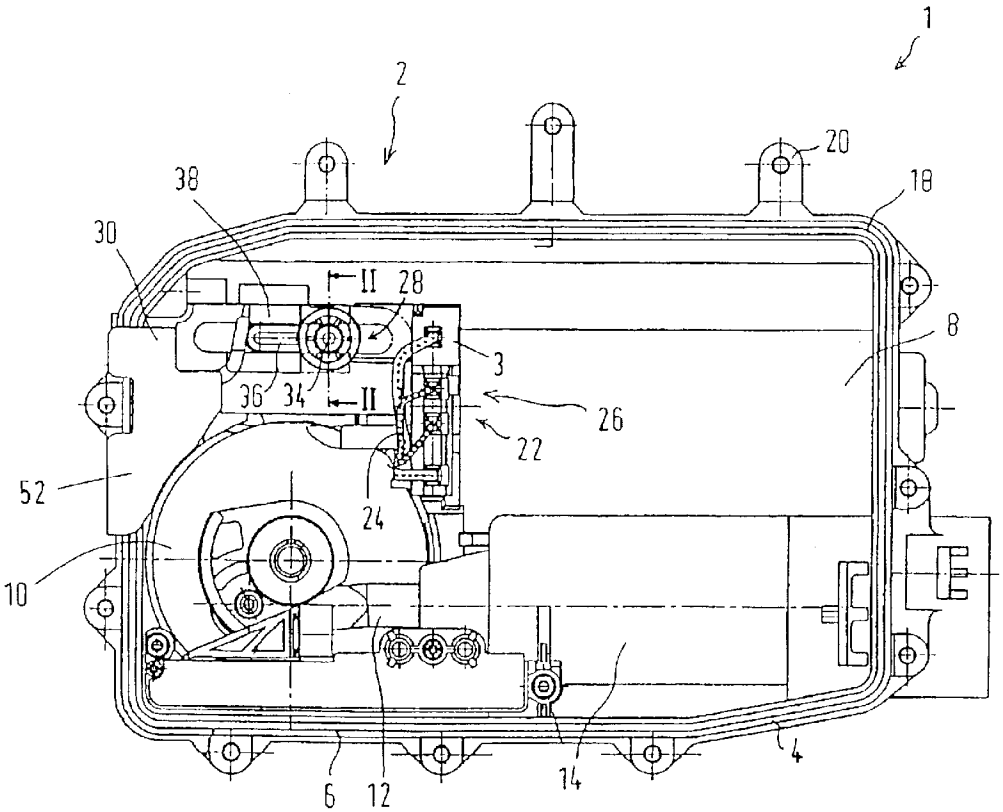
FIG. 1 is a top view of a housing bottom shell of a clutch actuator, into which an exemplary embodiment of an apparatus according to the invention for vibrationproof locking of a plug is integrated.
Figure 4:
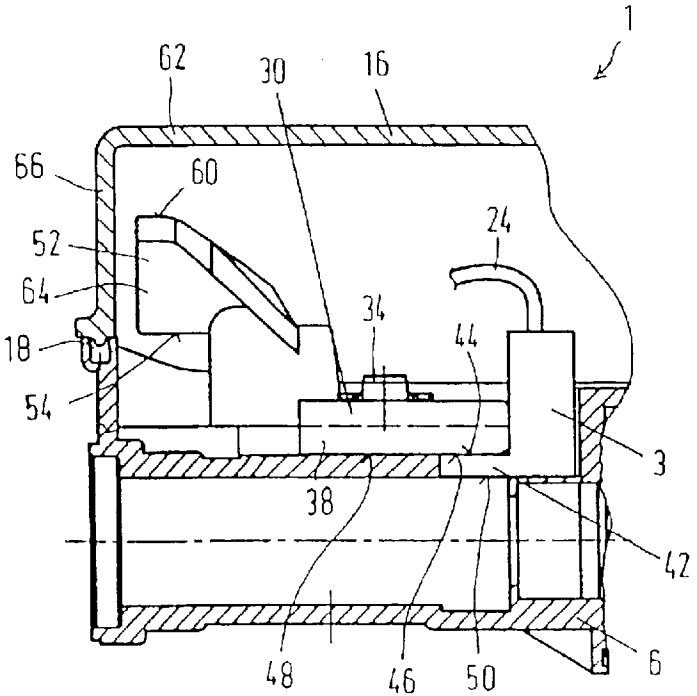
FIG. 4 shows a cross section through the clutch actuator from FIG. 1, in which the apparatus according to the invention is disposed in a locked position
Figure 3:
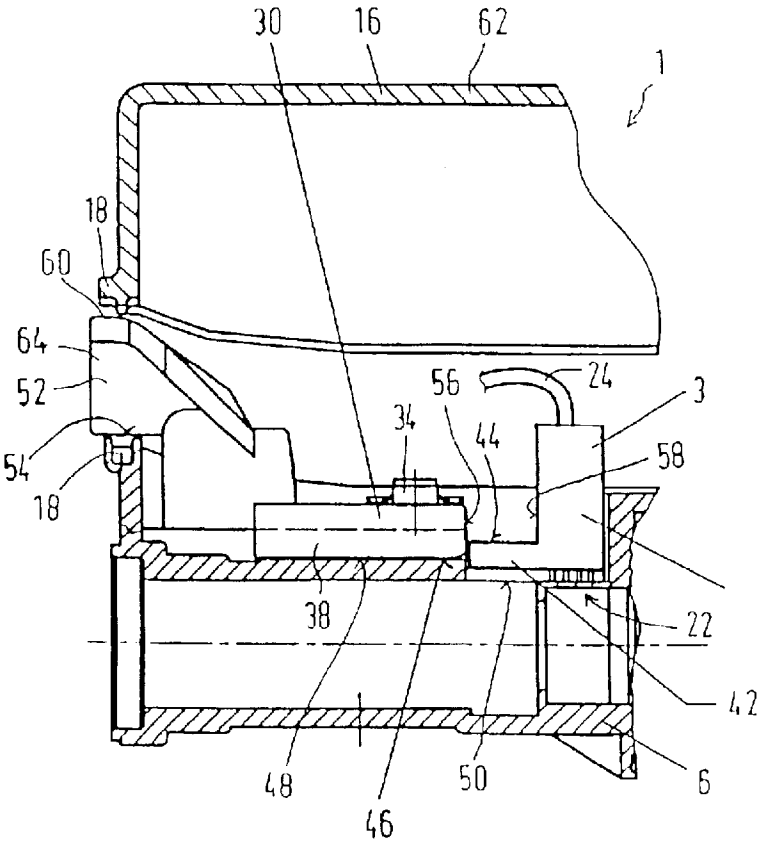
FIG. 3 shows a cross section through the clutch actuator from FIG. 1, in which the apparatus according to the invention is disposed in an unlocked position.

The clutch actuator 1 shown in FIG. 1, which is for engaging and disengaging a vehicle clutch, has an exemplary embodiment of an apparatus 2 for vibrationproof locking of a plug 3 in its plugged-in position integrated into it. The clutch actuator 1 is comprised of a dual-shelled housing 4, of which only a housing bottom shell 6 is shown in the top view FIG. 1, which contains an electric motor 8 with a crank mechanism 10 and a tappet 12, which is connected to a hydraulic master cylinder 14. The housing bottom shell 6 and the housing top shell 16, a cross section of which is depicted in FIGS. 3 and 4, each have an outer flange 18 formed onto them on which eyes 20 with through bores or threaded bores are embodied in order to be able to screw the two housing shells 6, 16 to each other with a seal between them. The function of a clutch actuator 1 of this kind is known to a sufficient degree from DE 197 01 739 A1 and therefore requires no further explanation.

Figure 2:
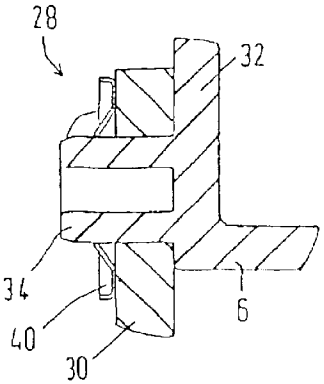
FIG. 2 shows an enlarged sectional depiction along the line II—II of FIG. 1.

In order to be supplied with power, the electric motor 8 has a connecting block 22 connected to it, with sockets into which plugs 26 connected to the ends of electrical lines 24 are plugged (FIG. 1). For vibrationproof locking of one of the plugs 3, a locking element is provided in the housing bottom shell 6 and can be guided, for example, by means of a linear guide 28; in the preferred embodiment, this locking element is a slider 30. The linear guide 28 of the slider 30 is produced by virtue of the fact that a pin 34, which is disposed next to the connecting block 22, protrudes from a wall 32 of the housing bottom shell 6, e.g. at right angles, and engages in an oblong hole 36 of a guide section 38 of the slider 30, which permits the slider 30 to move toward the plug 3 and away from it, preferably in a direction lateral to it. The pin 34 is secured in the oblong hole 36 of the slider 30 by a spring lock washer 40 press-fitted onto it from the outside, as best shown in the enlarged cross section in FIG. 2.

FIG. 3 shows a broken lateral cross sectional view of the clutch actuator 1, in an installation state before the joining of the two housing shells 6, 16, in which the plug 3 is not completely plugged into its associated socket 22. By contrast, FIG. 4 shows the correctly installed position after the joining of the two housing shells 6, 16.

The end of the plug 3 is preferably connected to a tab 42, which projects toward the slider 30 and whose underside facing away from a bottom of the housing bottom shell 6 has a for example horizontal locking surface 44 for a hold-down surface 46 on the underside of the guide section 38 of the slider 30, with which it can slide along a guide surface 48 embodied on the housing bottom shell 6. Consequently, the guide surface 48 for the slider 30 is preferably disposed in a plane with the hold-down surface 46 of the slider 30. In the completely plugged-in position of the plug 3 according to FIG. 4, the surface of the tab 42 oriented toward the bottom of the housing bottom shell 6 rests against a stop surface 50 of the housing bottom shell 6. The hold-down surface 46 on the slider 30 is only flush or coplanar with the locking surface 44 of the plug 3 when the plug is completely plugged in (FIG. 4). Only then can the slider 30 be slid toward the plug 3 and the hold-down surface 46 of the slider 30 overlap the locking surface 44 of the plug 3 in order to affix it to the connecting block 22.

On the side oriented away from the plug 3, the guide section 38 of the slider 30 is provided with a flat grasping section 52 in order to manually slide the slider 30 from the position shown in FIG. 3 in which the plug 3 is unlocked, into the position shown in FIG. 4 in which the plug 3 is locked. However, if the plug 3 is not completely plugged in, as in FIG. 3, or is plugged into the associated socket of the connecting block 22 in a tilted position, then the underside of its tab 42 is spaced apart from the stop surface 50, as a result of which the tab 42 of the plug 3 projects beyond the guide surface 48 for the slider 30 by a distance and as a result, prevents the slider 30 from sliding toward the plug 3.

With regard to its vertical span, a lower edge 54 of the grasping section 52 of the slider 30 oriented toward the bottom of the housing bottom shell 6 protrudes beyond the outer flange 18 of the housing bottom shell 6 independent of whether the locking position has been assumed or not. Moreover, the overhanging length of the grasping section 52, the relative position of the oblong hole 36 of the slider 30, and the length of this oblong hole 36 are selected so that in the unlocked or unlockable state of the plug 3, the grasping section 52 protrudes laterally beyond the outer contour of the housing bottom shell 6 constituted by the outer flange 18 so that in this case, it is not possible to join the two housing shells 6, 16. Consequently, the grasping section 52 simultaneously serves as a blocking section in order to prevent a further assembly of the clutch actuator 1 when the plug 3 is not completely plugged into the socket 22. By contrast, when the plug 3 is completely plugged in as shown in FIG. 4 and is disposed in the correct operating position, the hold-down surface 46 of the slider 30 can then overlap the coplanar locking surface 44 of the plug 3 and the slider 30 can travel into the locked position. The sliding motion of the slider 30 is determined among other things by the length and relative position of the oblong hole 36; these parameters are selected in such a way that when the slider 30 is in the locked position, its end surface 56 preferably contacts a side surface 58 of the plug 3 and the blocking section 52 no longer overlaps the outer flange 18 of the housing bottom shell 6. Then the blocking section 52 is disposed within the clutch actuator 1 periphery, which is predetermined by the outer contour. With regard to its vertical span, an upper edge 60 of the blocking section 52 is disposed underneath an upper wall 62 of the housing top shell 16 so that the latter can be joined to the housing bottom shell 6.

When mounted in place, the housing top shell 16 prevents the slider 30 from coming out of the locked position by virtue of the fact that the distance between the free end 64 of the blocking section 52 of the slider 30 and a side wall 66 of the housing top shell 16 is shorter than the sliding distance required for the unlocking. This produces a self-securing locking of the plug 3; it can only be unlocked after the housing shells 6, 16 are disassembled.

The apparatus 2 according to the invention is not limited to the locking of a single plug 3; instead, a number of plugs 26 can be locked by simply widening the slider 30 or by using several sliders 30.

What is claimed is:

1. An apparatus (2) for vibrationproof locking of a plug (3) in its plugged-in position inside a unit, which encompasses a housing (4) that has a housing top shell (16) and a housing bottom shell (6) by means of at least one locking element (30) that engages the plug (3), characterized in that the locking element (30) has a blocking section (52), which is kept in a blocking position by the plug (3) when the plug is not completely plugged in and prevents the housing shells (6, 16) from being joined, and can be brought into a position that permits the housing shells (6, 16) to be joined only when the plug (3) is completely plugged in, and only when the plug (3) is completely plugged in, is a section (44) of the plug (3) flush with an associated section (46) of the locking element (30) and only then can the locking element (30) be moved relative to the housing (4) into a locking position in which the section (44) of the plug (30) is overlapped by the associated section (46) of the locking element (30) in order to secure the plug (3) in the plugged-in position.

2. The apparatus according to claim 1, characterized in that the locking element is a slider (30), which is guided inside the housing bottom shell (6) by means of a linear guide (28), essentially lateral to a plugging direction of the plug (3), and has a hold-down surface (46), which when the plug (3) is completely plugged in, is coplanar to a locking surface (44) of the plug (3), wherein after the slider (30) is slid into the locked position, the locking surface (44) of the plug (3) is overlapped by the hold-down surface (46) of the slider (30).

3. The apparatus according to claim 2, characterized in that the linear guide (28) is constituted by an oblong hole (36) in the slider (30) and a pin (34), which protrudes through the oblong hole (30) and ins connected to the housing bottom shell (6), preferably secured by means of a spring lock washer (40) press-fitted onto it.

4. The apparatus according to claim 3, characterized in that when the slider (30) is in a position other than the locked position, the blocking section (52) extends laterally beyond an outer contour (18) of the housing shell (6) and in the locked position, is disposed inside the outer contour (6).

5. The apparatus according to claim 4, characterized in that the outer contour is constituted by an outer flange (18) of the housing bottom shell (6).

6. The apparatus according to claim 5, characterized in that with regard to its vertical span, a grasping section (52) is disposed between an upper wall (62) of the housing top shell (16) and the outer flange (18) of the housing bottom shell (6).

7. The apparatus according to claim 6, characterized in that the overhanging length of the grasping section (52), the relative position of the oblong hole (36) of the slider (30), and the length of this oblong hole (36) are selected so that in the unlocked or unlockable state of the plug (3), the grasping section (52) protrudes laterally beyond the outer contour of the housing bottom shell (6) constituted by the outer flange (18).

8. The apparatus according to claim 7, characterized in that the slider (30) is secured in the locked position by the housing top shell (16) that is joined to the housing bottom shell (6).

9. The apparatus according to claim 8, characterized in that the blocking section simultaneously serves as the grasping section (52) for actuating the slider (30) and is flat in design.

10. An apparatus (2) for vibrationproof locking of a plug (3) in its plugged-in position inside a unit, in particular inside, a clutch actuator (1), which encompasses a housing (4) that has a housing top shell (16) and a housing bottom shell (6) by means of at least one locking element (30) that engages the plug (3), characterized in that the locking element (30) has a blocking section (52), which is kept in a blocking position by the plug (3) when the plug is not completely plugged in and prevents the housing shells (6, 16) from being joined, and can be brought into a position that permits the housing shells (6, 16) to be joined only when the plug (3) is completely plugged in, and only when the plug (3) is completely plugged in, is a section (44) of the plug (3) flush with an associated section (46) of the locking element (30) and only then can the locking element (30) be moved relative to the housing (4) into a locking position in which the section (44) of the plug (30) is overlapped by the associated section (46) of the locking element (30) in order to secure the plug (3) in the plugged-in position.

* * * * *